US012779625B2

(12) United States Patent
Umezawa

(10) Patent No.: US 12,779,625 B2
(45) Date of Patent: Nov. 3, 2026

(54) WORKPIECE GRINDING METHOD

(71) Applicant: DISCO CORPORATION, Tokyo (JP)

(72) Inventor: Yujiro Umezawa, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 345 days.

(21) Appl. No.: 18/761,664

(22) Filed: Jul. 2, 2024

(65) Prior Publication Data

US 2025/0010430 A1 Jan. 9, 2025

(30) Foreign Application Priority Data

Jul. 6, 2023 (JP) ..... 2023-111138

(51) Int. Cl.
*B24B 51/00* (2006.01)
*B24B 7/04* (2006.01)

(52) U.S. Cl.
CPC ..... *B24B 51/00* (2013.01); *B24B 7/04* (2013.01)

(58) Field of Classification Search
CPC ..... B24B 37/005; B24B 37/04; B24B 37/042; B24B 37/10; B24B 37/102; B24B 37/105; B24B 7/04; B24B 7/07; B24B 7/075
See application file for complete search history.

(56) References Cited

U.S. PATENT DOCUMENTS 10,872,758 B2 * 12/2020 Hirata ..... B23K 26/3576
2011/0294233 A1 * 12/2011 Nakata ..... B24B 1/00 257/E21.53
2018/0308679 A1 * 10/2018 Hirata ..... B23K 26/3576
2022/0032503 A1 * 2/2022 Hirata ..... B28D 5/0011
2022/0088742 A1 * 3/2022 Yamamoto ..... B24B 19/02
2022/0314393 A1 * 10/2022 Suzuki ..... B24B 37/27

FOREIGN PATENT DOCUMENTS

JP 2013049161 A 3/2013

* cited by examiner

*Primary Examiner* — Joel D Crandall
(74) *Attorney, Agent, or Firm* — GREER BURNS & CRAIN, LTD

(57) ABSTRACT

A workpiece grinding method includes a holding step of holding the other surface side of a workpiece on a holding surface of a chuck table in such a manner that one surface side of the workpiece is exposed, a first grinding step of grinding the one surface side of the workpiece until the one surface side of the workpiece is flattened, after the holding step, and a second grinding step of grinding the one surface side of the workpiece while modifying a region to be ground of the workpiece by repeating increase and decrease in an area of contact between the workpiece and a plurality of grindstones.

6 Claims, 10 Drawing Sheets

WORKPIECE GRINDING METHOD

BACKGROUND OF THE INVENTION

Field of the Invention

The present invention relates to a workpiece grinding method for grinding one surface side of a workpiece in which surface roughness on the one surface side is greater than the surface roughness on the other surface side, by bringing a plurality of grindstones into contact with the one surface side of the workpiece.

Description of the Related Art

In general, chips of semiconductor devices are manufactured by using a wafer formed of a single crystal of silicon (Si), silicon carbide (Sic), gallium nitride (GaN), lithium tantalate ($LiTaO_3$:LT), lithium niobate ($LiNbO_3$:LN), or the like. The wafer is manufactured by separating an ingot in such a manner that a part on a front surface side thereof is peeled off.

As a method for separating the ingot, there has been proposed a method in which a laser beam of such a wavelength as to be transmitted through the blank material of the ingot is used (see, for example, Japanese Patent Laid-open No. 2013-49161). Specifically, in this method, while the laser beam is applied to the ingot in such a manner that a focal point of the laser beam is positioned inside the ingot, the focal point and the ingot are moved relative to each other.

As a result, a separation layer including a modified part and cracks extending from the modified part is formed inside the ingot. In this method, an external force is exerted on the ingot in such a manner that the cracks are further extended. As a result, the ingot is separated at the separation layer, in other words, a part on the front surface side of the ingot is peeled off from the ingot, whereby the wafer is manufactured.

SUMMARY OF THE INVENTION

When the wafer is manufactured as described above, ruggedness reflecting the distribution of the modified part and the cracks included in the separation layer is formed on one surface side (separation layer side) of the ingot and the wafer. In other words, a wafer and an ingot in each of which the surface roughness on the one surface side is greater than the surface roughness on the other surface side are formed.

Hence, the wafer manufactured in this way is subjected to grinding to be thinned to a desired thickness after the one surface side thereof is flattened, before served to manufacturing of the chips. In addition, the ingot left after the manufacturing of the wafer is subjected to grinding to be thinned to a desired thickness after the one surface side thereof is flattened, before served to the manufacturing of another wafer.

Such grinding is performed by use of a grinding wheel that includes an annular base and a plurality of grindstones provided on one surface of the base in a state of being dispersed in an annular pattern. Specifically, this type of grinding is performed by bringing the plurality of grindstones into contact with the one surface side of the wafer or ingot, while both the wafer or ingot and the grinding wheel are rotated.

It is to be noted, however, that, when the ruggedness is formed on the one surface side of each of the ingot and the wafer as described above, the grindstones may excessively be worn during that period of the grinding period which is until the one surface side of the ingot or wafer is flattened. In view of this, the grinding is often carried out by utilizing a grinding wheel including grindstones which are not liable to be worn (for example, grindstones high in hardness).

Meanwhile, in the case where the ingot or wafer is ground by use of a grinding wheel including grindstones which are not liable to be worn, self-sharpening of the grindstones may be restrained during that period of the grinding period which is after the one surface side of the ingot or wafer is flattened. In this case, the probability of breakage of the ingot or wafer due to the exertion of a heavy load thereon for a long period of time becomes high.

In consideration of the above-mentioned points, it is an object of the present invention to provide a workpiece grinding method by which it is possible to lower the probability of breakage of a workpiece, such as a wafer or an ingot, in which the surface roughness on one surface side is greater than the surface roughness on the other surface side, when the workpiece is thinned to a desired thickness after one surface side of the workpiece is flattened.

In accordance with an aspect of the present invention, there is provided a workpiece grinding method for grinding one surface side of a workpiece in which surface roughness on the one surface side is greater than the surface roughness on the other surface side, by bringing a plurality of grindstones into contact with the one surface side of the workpiece in a grinding apparatus including a chuck table rotatable with a straight line passing through a center of a holding surface as a rotational axis and a spindle having mounted to a tip part thereof a grinding wheel including an annular base and the plurality of grindstones provided on one surface of the base in a state of being dispersed in an annular pattern, while rotating both the chuck table and the spindle, the workpiece grinding method including a holding step of holding the other surface side of the workpiece on the holding surface of the chuck table in such a manner that the one surface side of the workpiece is exposed, a first grinding step of grinding the one surface side of the workpiece until the one surface side of the workpiece is flattened, after the holding step, and a second grinding step of grinding the one surface side of the workpiece while modifying a region to be ground of the workpiece by repeating increase and decrease in the area of contact between the workpiece and the plurality of grindstones, after the first grinding step.

Further, in the second grinding step, it is preferable to repeat the increase and the decrease in the area of contact by varying the spacing between the spindle and the center of the holding surface in a direction orthogonal to a direction along the spindle. Alternatively, in the second grinding step, it is preferable to repeat the increase and the decrease in the area of contact by varying an angle formed between a direction along the spindle and a direction along the rotational axis of the chuck table.

Further, it is preferable that the workpiece grinding method of the present invention further include a final grinding step of grinding the one surface side of the workpiece in such a manner that the area of contact is not varied, after the second grinding step.

In the present invention, the one surface side of the workpiece is ground while the region to be ground of the workpiece is modified by repeating increase and decrease in the area of contact between the workpiece and the plurality of grindstones, after the one surface side of the workpiece is ground until the one surface side of the workpiece is flattened. When the area of contact between the workpiece and the plurality of grindstones is reduced, the load exerted on the workpiece is reduced.

Further, when the increase and the decrease in the area of contact between the workpiece and the plurality of grindstones are repeated, self-sharpening of each of the plurality of grindstones is accelerated, and the load exerted on the workpiece is reduced. Hence, in the present invention, it is possible to reduce the probability of breakage of the workpiece attributable to the exertion of a heavy load thereon for a long period of time.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
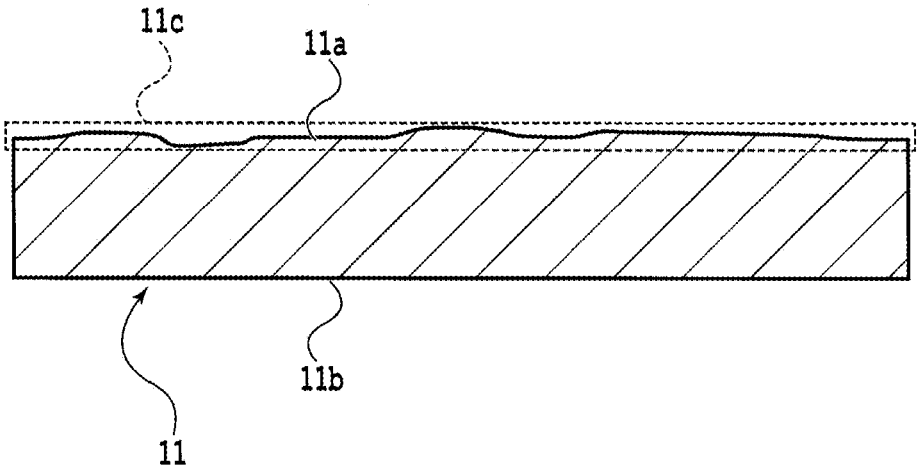
FIG. 1 is a sectional view schematically depicting an example of a workpiece.

An embodiment of the present invention will be described with reference to the attached drawings. FIG. 1 is a sectional view schematically depicting an example of a workpiece. A workpiece 11 depicted in FIG. 1 is formed of a single crystal of, for example, Si, SiC, GaN, LT, LN, or the like.

The workpiece 11 is, for example, a wafer manufactured by forming a separation layer in a cylindrical ingot with use of a laser beam and then separating the ingot at the separation layer, or the ingot left after the manufacture of the wafer.

In addition, in the workpiece 11, the surface roughness on one surface 11*a* side (for example, on the separation layer side) is greater than the surface roughness on the other surface 11*b* side. In other words, while a rugged part 11*c* is present on the one surface 11*a* side of the workpiece 11, the other surface 11*b* of the workpiece 11 is substantially flat.

Figure 2:
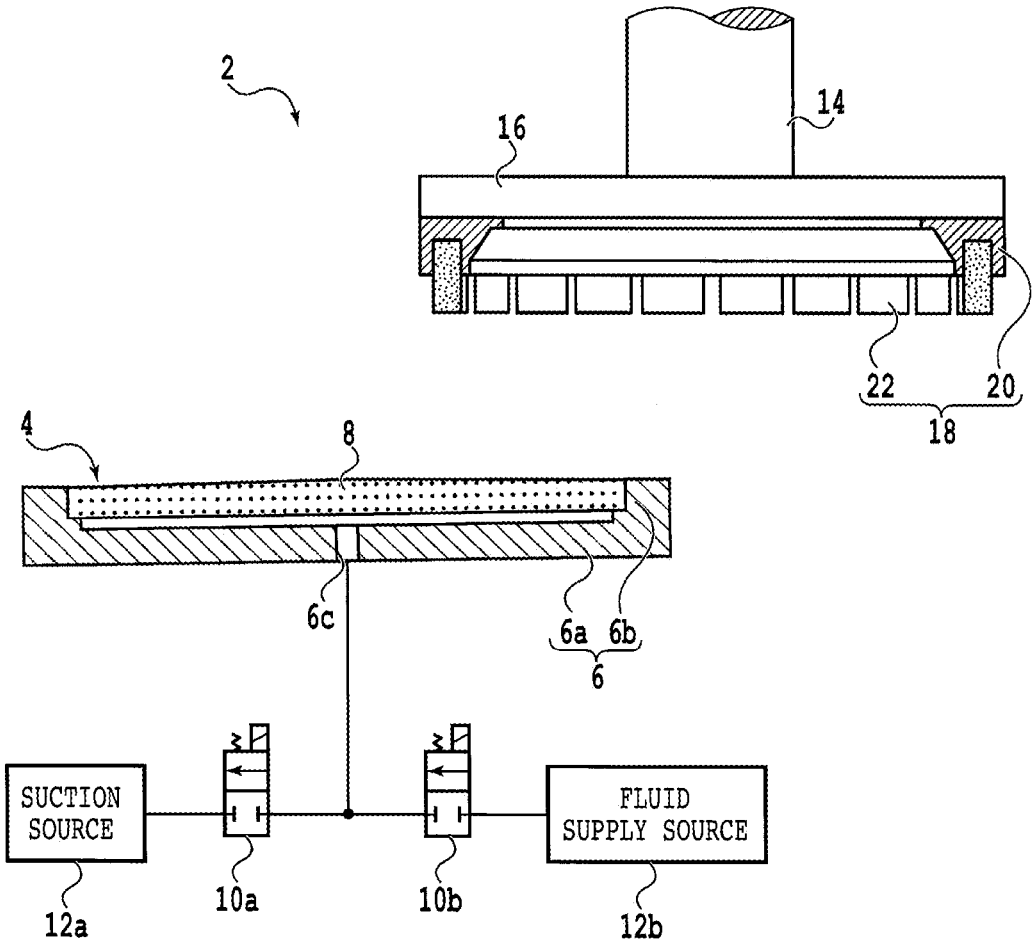
FIG. 2 is a diagram schematically depicting an example of a grinding apparatus for grinding one surface side of the workpiece depicted in FIG. 1.

FIG. 2 is a diagram schematically depicting an example of a grinding apparatus for grinding the one surface 11*a* side of the workpiece 11. The grinding apparatus 2 depicted in FIG. 2 has a disk-shaped chuck table 4 greater in diameter than the workpiece 11. The chuck table 4 has a frame body 6 formed of ceramic or the like.

The frame body 6 has a disk-shaped bottom wall 6*a* and a cylindrical side wall 6*b* erected from a peripheral part of the bottom wall 6*a*. In other words, on an upper surface side of the frame body 6, a recess is defined by the bottom wall 6*a* and the side wall 6*b*. In the recess, a disk-shaped porous plate 8 formed of porous ceramic or the like is fixed.

Note that the diameter of the porous plate 8 is smaller than the diameter of the workpiece 11. In addition, an upper surface of the side wall 6*b* of the frame body 6 and an upper surface of the porous plate 8 each have a shape corresponding to a side surface of a cone, and function as a holding surface of the chuck table 4 at the time of holding the other surface 11*b* side of the workpiece 11.

Besides, the bottom wall 6*a* is formed with a channel 6*c* that is opened in a bottom surface of the recess and that penetrates the bottom wall 6*a*. The channel 6*c* communicates with a suction source 12*a* via a valve 10*a* and communicates with a fluid supply source 12*b* via a valve 10*b*.

The suction source 12*a* includes, for example, an ejector or the like. Besides, the fluid supply source 12*b* includes, for example, a tank for reserving a high-pressure gas, a filter for removing foreign matter mixed into the gas supplied from the tank, and a regulator for adjusting the pressure of the gas supplied from the tank.

Further, the chuck table 4 is connected to a rotating mechanism (not illustrated). The rotating mechanism includes, for example, a motor, a pulley, and the like. When the rotating mechanism is operated, the chuck table 4 is rotated with a straight line passing through the center of the holding surface of the chuck table 4 as a rotational axis.

In addition, the chuck table 4 is supported by an inclination adjusting mechanism (not illustrated) through a bearing (not illustrated) or the like. The inclination adjusting mechanism includes, for example, two movable shafts and one stationary shaft that are disposed at substantially the same angular intervals along a circumferential direction of the chuck table 4. When at least one of the two movable shafts partially lifts or lowers the chuck table 4, the inclination of the rotational axis of the chuck table 4 is adjusted.

On an upper side of the chuck table 4, there is provided a spindle 14 which extends along the vertical direction. A lower end part (tip part) of the spindle 14 is a disk-shaped mount 16. Note that the diameter of the mount 16 is greater than the radius of the workpiece 11.

In addition, a peripheral part of the mount 16 is formed with a plurality of holes (not illustrated) that penetrate the mount 16 in a thickness direction of the mount 16, and a bolt (not illustrated) is inserted in each of the holes. Further, a grinding wheel 18 is mounted to a lower surface of the mount 16 by use of a plurality of bolts.

The grinding wheel 18 has, for example, an annular base 20 formed of a metallic material such as stainless steel or an aluminum alloy. Note that the outside diameter of the base 20 is substantially equal to the diameter of the mount 16, and a plurality of grindstones 22 are provided on a lower surface of the base 20 in the state of being dispersed in an annular pattern.

Each of the plurality of grindstones 22 includes a bonding material, such as a vitrified bond or a resin bond, and abrasive grains of diamond or the like dispersed in the bonding material. The abrasive grains are exposed at a lower surface of each of the plurality of grindstones 22, and the lower surface functions as a grinding surface at the time of grinding the one surface 11*a* side of the workpiece 11.

Note that when a rugged part 11*c* present on the one surface 11*a* side of the workpiece 11 is ground by the plurality of grindstones 22, each grindstone 22 may be worn excessively. Hence, as each grindstone 22, a grindstone which is not liable to be worn is preferably applied. Specifically, each grindstone 22 preferably includes a vitrified bond as a binder (bonding material).

Further, a motor (not illustrated) is connected to a base end part (upper end part) of the spindle 14. When this motor is operated, the grinding wheel 18 is rotated together with the spindle 14 with a straight line along the direction in which the spindle 14 extends (here, the vertical direction) as a rotational axis. In this instance, each of the respective grinding surfaces of the plurality of grindstones 22 describes an annular locus having an outside diameter greater than the radius of the workpiece 11.

In addition, the spindle 14 is connected to a horizontal direction moving mechanism (not illustrated) and a vertical direction moving mechanism (not illustrated). These moving mechanisms each include, for example, a motor, a ball screw, and the like. When the horizontal direction moving mechanism is operated, the spindle 14 is moved along a horizontal direction, and, when the vertical direction moving mechanism is operated, the spindle 14 is moved along the vertical direction.

Figure 3:
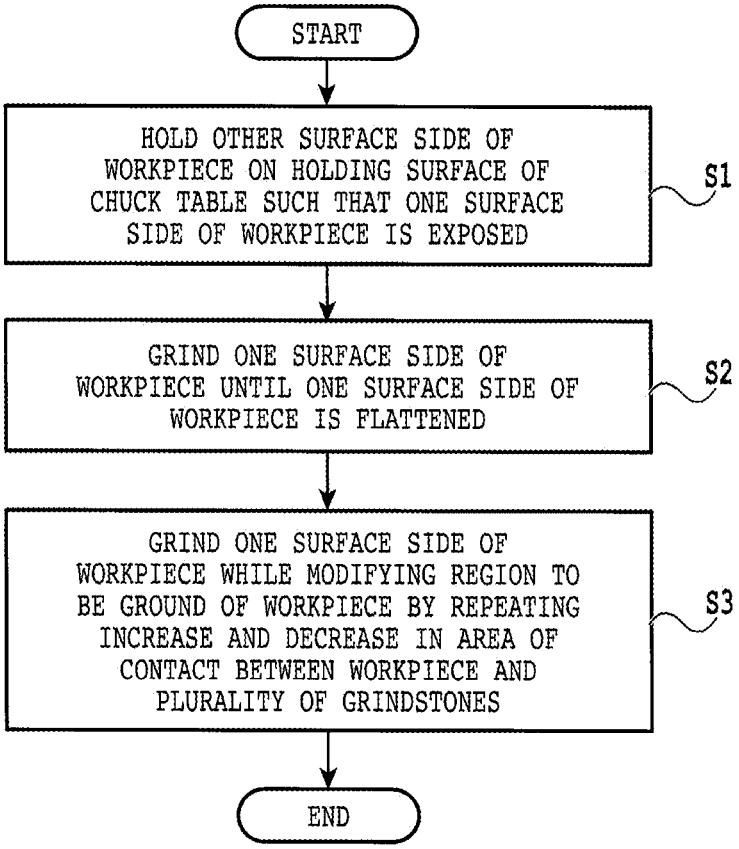
FIG. 3 is a flow chart schematically depicting an example of a workpiece grinding method for grinding the one surface side of the workpiece depicted in FIG. 1 by the grinding apparatus depicted in FIG. 2.

FIG. 3 is a flow chart schematically depicting an example of the workpiece grinding method for grinding the one surface 11*a* side of the workpiece 11 by the grinding apparatus 2. In this method, first, the other surface 11*b* side of the workpiece 11 is held on the holding surface of the chuck table 4 in such a manner that the one surface 11*a* side of the workpiece 11 is exposed (holding step S1).

Figure 4:
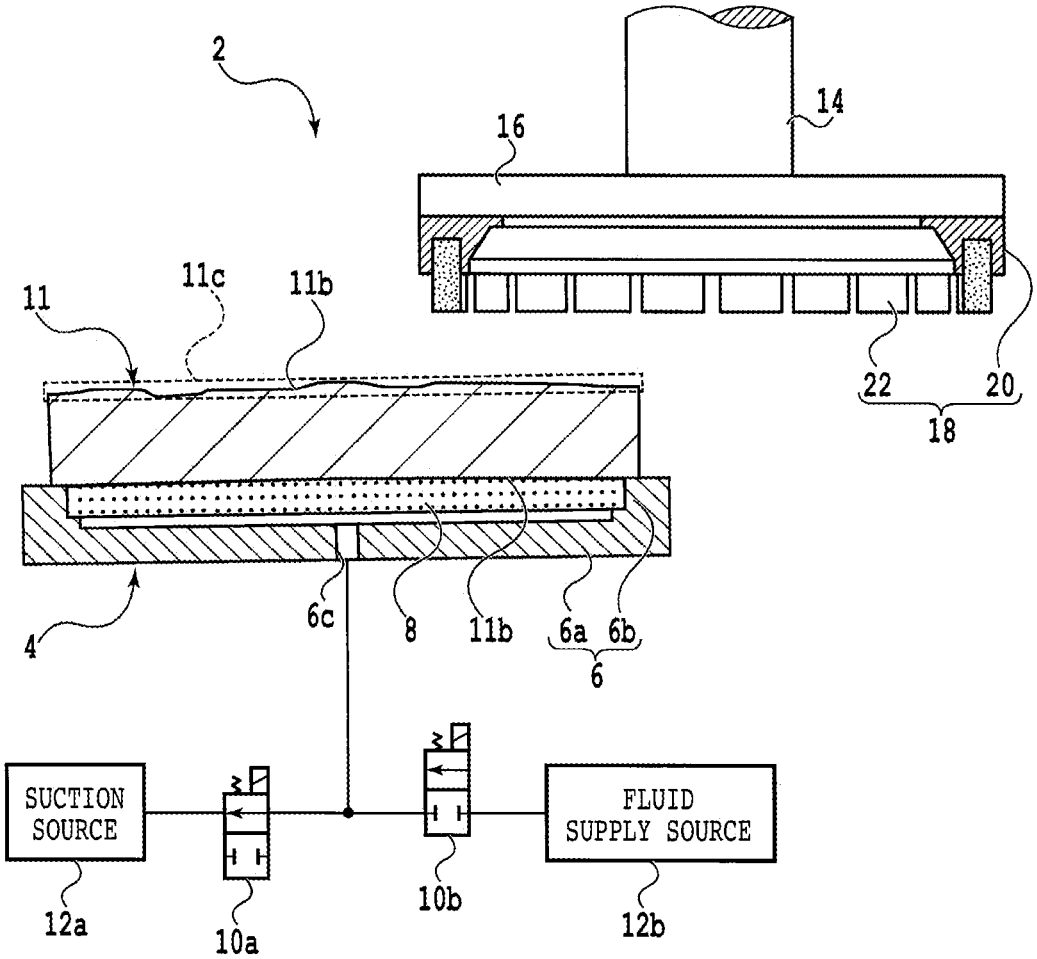
FIG. 4 is a diagram schematically depicting the manner of an example of a holding step depicted in FIG. 3.

FIG. 4 is a diagram schematically depicting the manner of an example of the holding step S1. In this holding step S1, first, the workpiece 11 is placed on the holding surface of the chuck table 4 in such a manner that the one surface 11*a* thereof is directed upward and covers the porous plate 8. Next, the suction source 12*a* is operated, and the valve 10*a* is put into an open state.

As a result, a suction force acts on the other surface 11*b* side of the workpiece 11 via the channel 6*c* formed in the bottom wall 6*a* of the frame body 6 of the chuck table 4 and the porous plate 8. Consequently, the workpiece 11 is held on the holding surface of the chuck table 4 in such a state of being elastically deformed to be located along the holding surface of the chuck table 4, specifically, in such a state of being elastically deformed such that the other surface 11*b* thereof is deformed into a shape corresponding to a side surface of a cone. By these operations, the holding step S1 is completed.

After the holding step S1, the one surface 11*a* side of the workpiece 11 is ground until the one surface 11*a* side of the workpiece 11 is flattened (first grinding step S2). Note that the flattening of the one surface 11*a* side of the workpiece 11 in the first grinding step S2 means that the rugged part 11*c* is removed from the one surface 11*a* side of the workpiece 11.

In other words, the flattening of the one surface 11*a* side of the workpiece 11 means that the thickness of the whole region of the workpiece 11 is set to be equal to or not more than the spacing between the most recessed part of the rugged part 11*c* and the other surface 11*b*. In addition, the thickness of the rugged part 11*c*, that is, the spacing between the most projected part and the most recessed part of the rugged part 11*c*, is, for example, 10 to 50 μm.

Figure 5:
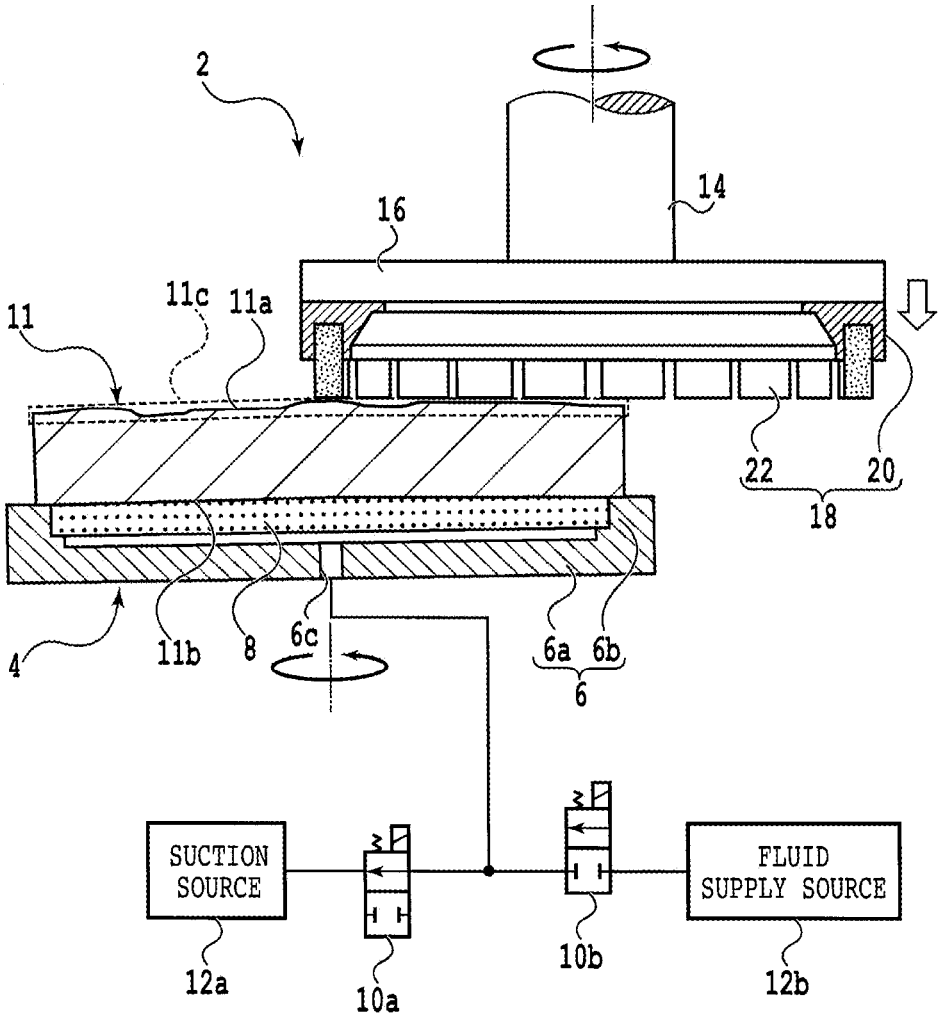
FIG. 5 is a diagram schematically depicting the manner of an example of a first grinding step depicted in FIG. 3.

FIG. 5 is a diagram schematically depicting the manner of an example of the first grinding step S2. In the first grinding step S2, first, the spindle 14 is moved along a horizontal direction in such a manner that the locus of each of the respective grinding surfaces of the plurality of grindstones 22 when the spindle 14 is rotated is located at a position directly above the center of the holding surface of the chuck table 4. Next, the inclination of the chuck table 4 is adjusted in such a manner that that part of the holding surface of the chuck table 4 which overlaps with the locus is located at an uppermost position.

Next, while both the chuck table 4 and the spindle 14 are being rotated, the spindle 14 is lowered. Note that the rotating speed of the chuck table 4 in the first grinding step S2 is, for example, 1,000 to 4,000 rpm, and the rotating speed of the spindle 14 is, for example, 40 to 500 rpm. In addition, the lowering speed of the spindle 14 in the first grinding step S2 is, for example, 0.2 to 0.8 μm/s.

As a result, the plurality of grindstones 22 make contact with the rugged part 11*c* located on the one surface 11*a* side of the workpiece 11, whereby the most projected parts of the rugged part 11*c* are ground. This grinding, in other words, the lowering of the spindle 14 while both the chuck table 4 and the spindle 14 are rotated, is continued until the rugged part 11*c* is removed. By these operations, the first grinding step S2 is completed.

After the first grinding step S2, the one surface 11*a* side of the workpiece 11 is ground while the region to be ground of the workpiece 11 is modified by repeating increase and decrease in the area of contact between the workpiece 11 and the plurality of grindstones 22 (second grinding step S3).

In the second grinding step S3, for example, while both the chuck table 4 and the spindle 14 are being rotated, the spindle 14 is lowered and oscillated. Note that the oscillation of the spindle 14 means, for example, repetition of a first operation for reducing the area of contact between the workpiece 11 and the plurality of grindstones 22 and a second operation for increasing the area of contact.

Figure 6:
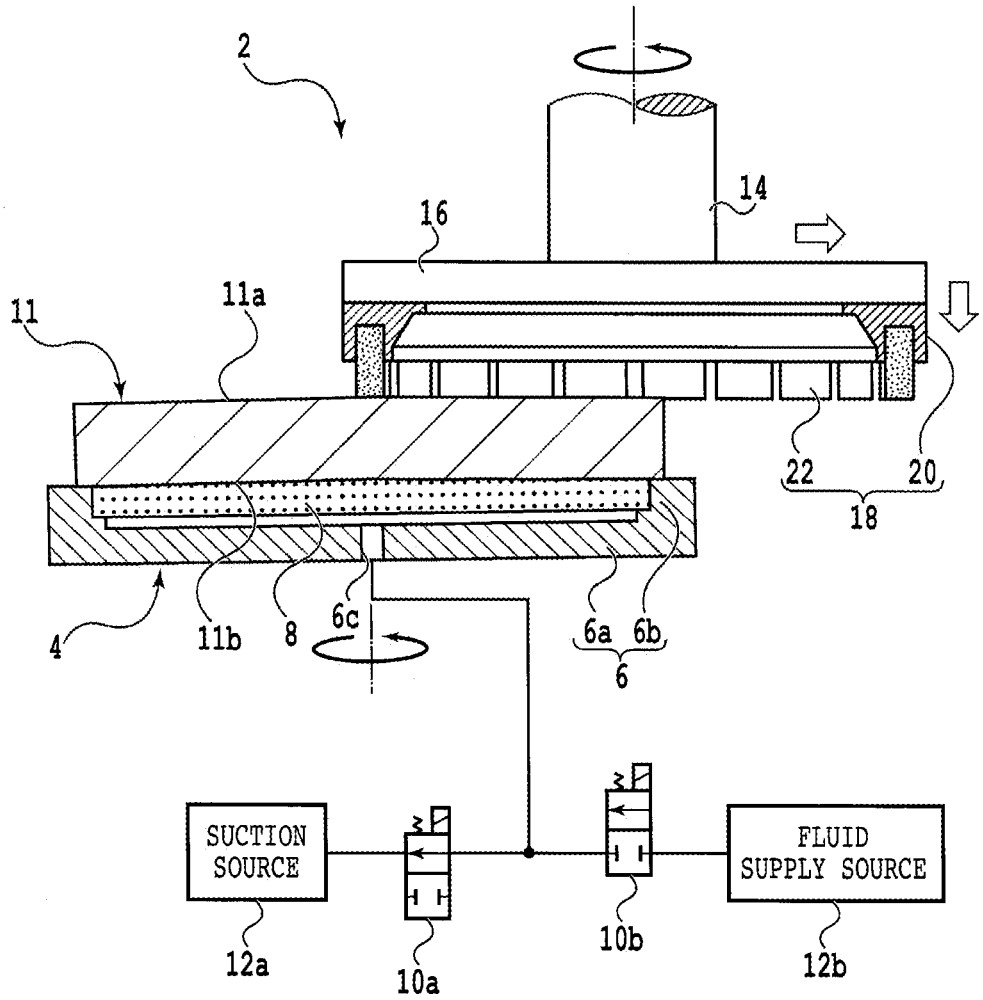
FIG. 6 is a diagram schematically depicting the manner of a first operation in an example of a second grinding step depicted in FIG. 3.

FIG. 6 is a diagram schematically depicting the manner of the first operation. Specifically, the first operation means movement of the spindle 14 in a predetermined direction orthogonal to the direction in which the spindle 14 extends (here, the vertical direction). The first operation is continued, for example, until the spacing between the spindle 14 and the center of the holding surface of the chuck table 4 in the predetermined direction is increased and each of the respective grinding surfaces of the plurality of grindstones 22 and the center of the one surface 11*a* of the workpiece 11 become spaced from each other.

Figure 7:
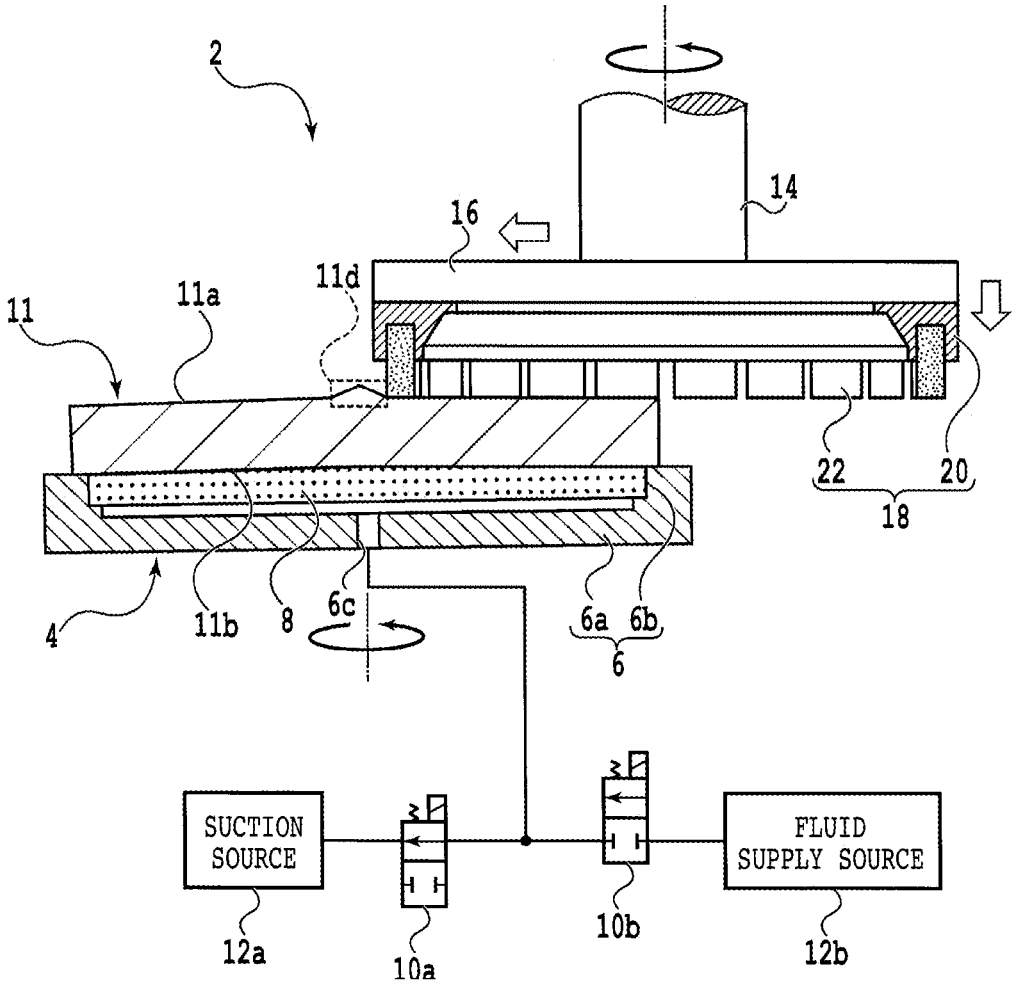
FIG. 7 is a diagram schematically depicting the manner of a second operation in an example of the second grinding step depicted in FIG. 3.

FIG. 7 is a diagram schematically depicting the manner of the second operation. Specifically, the second operation means movement of the spindle 14 in a direction opposite to the predetermined direction. The second operation is continued, for example, until the spacing between the spindle 14 and the center of the holding surface of the chuck table 4 in the predetermined direction is reduced and each of the respective grinding surfaces of the plurality of grindstones 22 and the center of the one surface 11*a* of the workpiece 11 make contact with each other again.

Note that the rotating speed of the chuck table 4 in the second grinding step S3 is, for example, 1,000 to 4,000 rpm, and the rotating speed of the spindle 14 is, for example, 40 to 500 rpm. Besides, the lowering speed of the spindle 14 in the second grinding step S3 is, for example, 0.2 to 0.8 μm/s.

In addition, the moving speed of the spindle 14 along the predetermined direction is, for example, 50 to 5,000 μm/s. Besides, the switching between the first operation and the second operation in the second grinding step S3 is performed at the timing when the moving distance of the spindle 14 along the predetermined direction in each of the first operation and the second operation has become a predetermined distance of 5 to 50 mm.

As a result, grinding of a region other than the vicinity of the center of the one surface 11*a* side of the workpiece 11 in such a manner as to leave a projected part 11*d* having a shape corresponding to a side surface of a cone in the center on the one surface 11*a* side of the workpiece 11, that is, grinding accompanied by the first operation, and grinding of the whole region on the one surface 11*a* side of the workpiece 11 in such a manner as to flatten the one surface 11*a* side of the workpiece 11, that is, grinding accompanied by the second operation, are alternately repeated.

The alternate repetition of the grinding accompanied by the first operation and the grinding accompanied by the second operation is continued until the workpiece 11 reaches a predetermined finished thickness. In addition, in this case, in the second grinding step S3, grinding accompanied by the second operation is carried out at the end in order to flatten the one surface 11*a* side of the workpiece 11 that is eventually obtained.

In the workpiece grinding method depicted in FIG. 3, after the one surface 11*a* side of the workpiece 11 is ground until the one surface 11*a* side of the workpiece 11 is flattened, the one surface 11*a* of the workpiece 11 is ground while the region to be ground of the workpiece 11 is modified by repeating the increase and the decrease in the area of contact between the workpiece 11 and the plurality of grindstones 22. When the area of contact between the workpiece 11 and the plurality of grindstones 22 is reduced, the load exerted on the workpiece 11 is reduced.

Further, when the increase and the decrease in the area of contact between the workpiece 11 and the plurality of grindstones 22 are repeated, the self-sharpening of each of the plurality of grindstones 22 is accelerated, and the load exerted on the workpiece 11 is reduced. Hence, in the workpiece grinding method depicted in FIG. 3, it is possible to lower the probability of breakage of the workpiece 11 attributable to the exertion of a heavy load on the workpiece 11 for a long period of time.

Note that the contents of the above description are merely one mode of the present invention, and the invention is not to be limited by the contents of the above description. For example, the present invention may be carried out in a grinding apparatus in which a horizontal direction moving mechanism and/or a vertical direction moving mechanism for moving the chuck table 4 is provided in place of or in addition to the horizontal direction moving mechanism and/or the vertical direction moving mechanism for moving the spindle 14.

Similarly, the present invention may be carried out in a grinding apparatus in which an inclination adjusting mechanism for adjusting the inclination of the spindle 14 is provided in place of or in addition to the inclination adjusting mechanism for adjusting the inclination of the chuck table 4. In other words, in the present invention, it is sufficient if the chuck table 4 and the spindle 14 can be moved relative to each other and the structures therefor are not limited in any way.

In addition, in the present invention, for example, in the second grinding step S3, the grinding accompanied by the first operation and the grinding accompanied by the second operation may be alternately repeated by oscillating the chuck table 4, in place of or in addition to oscillating the spindle 14.

Besides, in the second grinding step S3 of the present invention, it is sufficient if the one surface 11*a* side of the workpiece 11 can be ground while the region to be ground of the workpiece 11 is modified by repeating the increase and the decrease in the area of contact between the workpiece 11 and the plurality of grindstones 22, and the operations therefor are not limited in any way.

For example, in the second grinding step S3 of the present invention, the increase and the decrease in the area of contact between the workpiece 11 and the plurality of grindstones 22 may be repeated by varying the angle formed between the direction along the spindle 14 and the direction along the rotational axis of the chuck table 4.

Specifically, in the second grinding step S3 of the present invention, lowering of the spindle 14 and swaying of the chuck table 4 may be performed while both the chuck table 4 and the spindle 14 are being rotated. Note that the sway of the chuck table 4 means repetition of a third operation for decreasing the area of contact between the workpiece 11 and the plurality of grindstones 22 and a fourth operation for increasing the area of contact.

Figure 8:
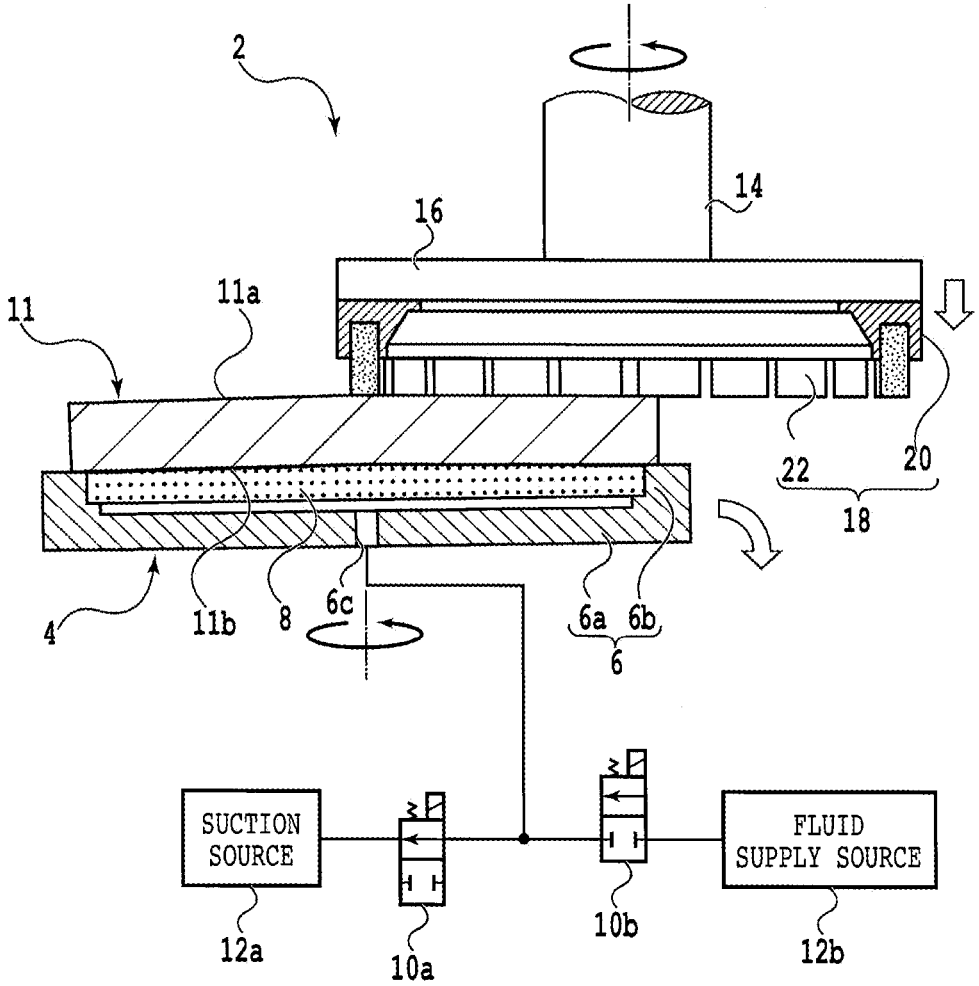
FIG. 8 is a diagram schematically depicting the manner of a third operation in another example of the second grinding step depicted in FIG. 3.

FIG. 8 is a diagram schematically depicting the manner of the third operation. Specifically, the third operation means adjustment of the inclination of the chuck table 4 in such a manner as to cause a peripheral part of the workpiece 11 to be spaced from the plurality of grindstones 22. This third operation is continued, for example, until at least a region other than the vicinity of the center of the one surface 11*a* side of the workpiece 11 is spaced from the respective grinding surfaces of the plurality of grindstones 22.

Figure 9:
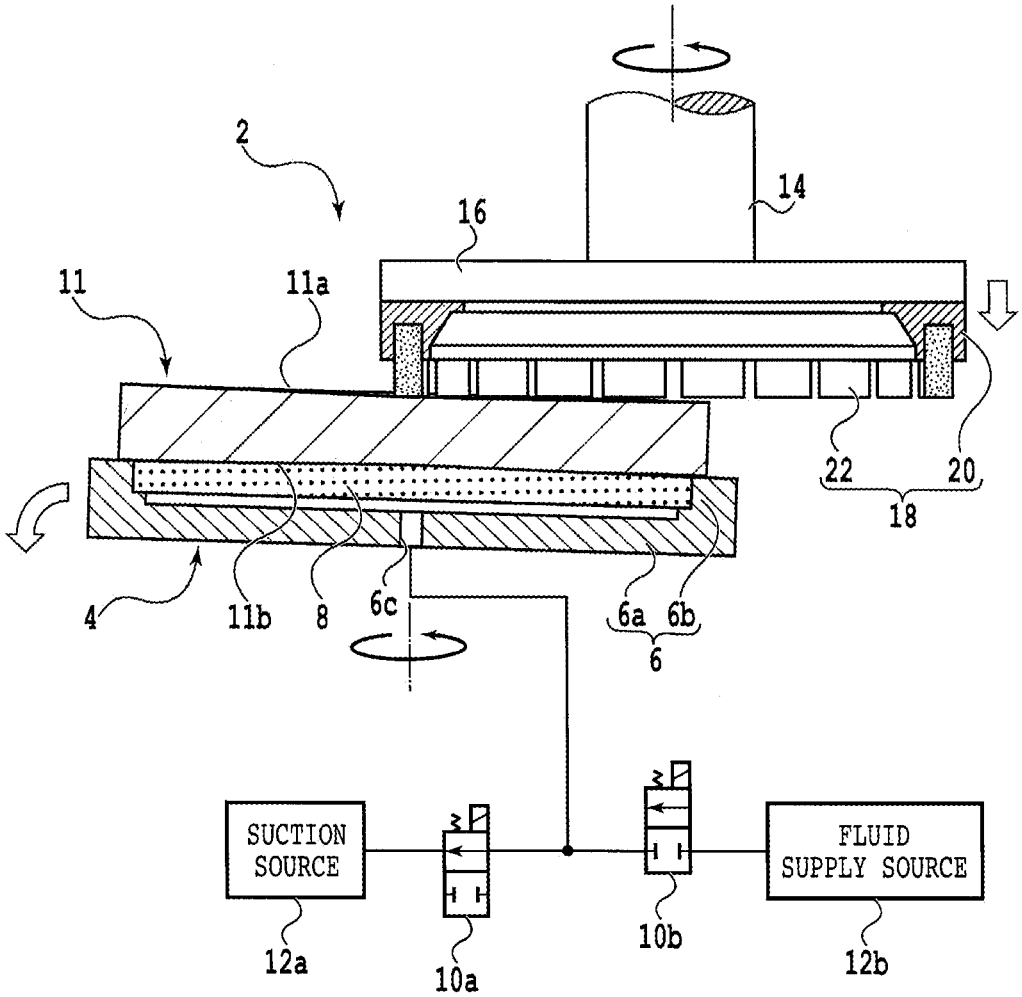
FIG. 9 is a diagram schematically depicting the manner of a fourth operation in another example of the second grinding step depicted in FIG. 3.

FIG. 9 is a diagram schematically depicting the manner of the fourth operation. Specifically, the fourth operation means adjustment of the inclination of the chuck table 4 in such a manner as to cause a peripheral part of the workpiece 11 to come into contact with the plurality of grindstones 22. This fourth operation is continued, for example, until the whole region from the center to the periphery of the one surface 11*a* side of the workpiece 11 comes into contact with the respective grinding surfaces of the plurality of grindstones 22.

As a result, grinding of a region in the vicinity of the center of the one surface 11*a* side of the workpiece 11 in such a manner as to deform the one surface 11*a* side of the workpiece 11 into a shape corresponding to a side surface of an inverted truncated cone, that is, grinding accompanied by the third operation, and grinding of the whole region of the one surface 11*a* side of the workpiece 11 in such a manner as to flatten the one surface 11*a* side of the workpiece 11, that is, grinding accompanied by the fourth operation, are alternately repeated.

The alternate repetition of the grinding accompanied by the third operation and the grinding accompanied by the fourth operation is continued until the workpiece 11 reaches a predetermined finished thickness. In addition, in this case, in the second grinding step S3, the grinding accompanied by the fourth operation is carried out at the end in order to flatten the one surface 11*a* side of the workpiece 11 that is eventually obtained.

In addition, in the present invention, for example, in the second grinding step S3, the grinding accompanied by the third operation and the grinding accompanied by the fourth operation may be alternately repeated by swaying the spindle 14, in place of or in addition to swaying the chuck table 4.

Figure 10:
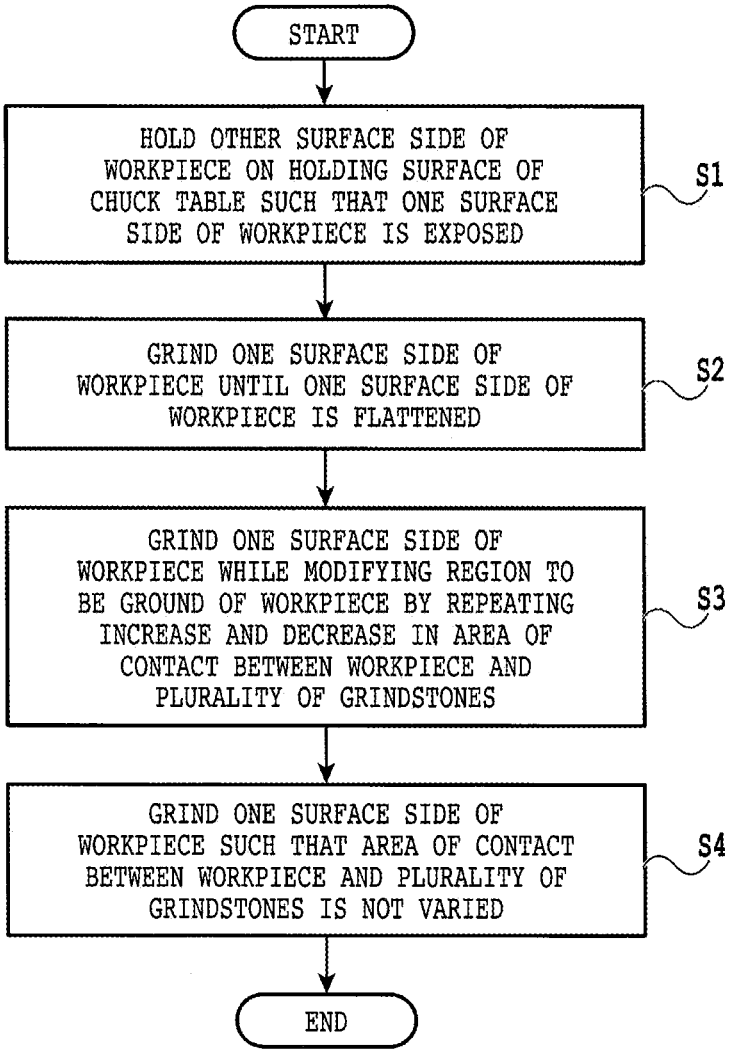
FIG. 10 is a flow chart schematically depicting another example of the workpiece grinding method for grinding the one surface side of the workpiece depicted in FIG. 1 by the grinding apparatus depicted in FIG. 2.

Besides, in the present invention, the workpiece 11 may not be ground to the finished thickness in the second grinding step S3, and, thereafter, the one surface 11*a* side of the workpiece 11 may be further ground to reach the finished thickness. FIG. 10 is a flow chart schematically depicting an example of a workpiece grinding method in which such grinding is carried out.

In this method, after the holding step S1, the first grinding step S2, and the second grinding step S3 are carried out as described above, the one surface 11*a* side of the workpiece 11 is ground in such a manner as not to vary the area of contact between the workpiece 11 and the plurality of grindstones 22 (final grinding step S4). The final grinding step S4 is carried out, for example, by operating the constituent elements of the grinding apparatus 2 in a way similar to that in the first grinding step S2.

Note that the rotating speed of the chuck table 4 in the final grinding step S4 is, for example, 1,000 to 4,000 rpm, and the rotating speed of the spindle 14 is, for example, 40 to 500 rpm. Besides, the lowering speed of the spindle 14 in the final grinding step S4 is, for example, 0.2 to 0.8 μm/s.

In the workpiece grinding method depicted in FIG. 10, it is possible to easily flatten the one surface 11*a* side of the workpiece 11 having the finished thickness, as compared to the workpiece grinding method depicted in FIG. 3.

Other than the above-mentioned points, structures, methods, and the like concerning the above-described embodiment can be modified as needed in carrying out the present invention insofar as the modifications do not depart from the scope of the object of the invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A workpiece grinding method for grinding one surface side of a workpiece in which surface roughness on the one surface side is greater than the surface roughness on the other surface side, by bringing a plurality of grindstones into contact with the one surface side of the workpiece in a grinding apparatus including a chuck table rotatable with a straight line passing through a center of a holding surface as a rotational axis and a spindle having mounted to a tip part thereof a grinding wheel including an annular base and the plurality of grindstones provided on one surface of the base in a state of being dispersed in an annular pattern, while rotating both the chuck table and the spindle, the workpiece grinding method comprising:

a holding step of holding the other surface side of the workpiece on the holding surface of the chuck table in such a manner that the one surface side of the workpiece is exposed;

a first grinding step of grinding the one surface side of the workpiece until the one surface side of the workpiece is flattened, after the holding step; and a second grinding step of grinding the one surface side of the workpiece while modifying a region to be ground of the workpiece by repeating increase and decrease in an area of contact between the workpiece and the plurality of grindstones, after the first grinding step.

2. The workpiece grinding method according to claim 1, further comprising:

a final grinding step of grinding the one surface side of the workpiece in such a manner that the area of contact is not varied, after the second grinding step.

3. The workpiece grinding method according to claim 1, wherein, in the second grinding step, the increase and the decrease in the area of contact are repeated by varying spacing between the spindle and the center of the holding surface in a direction orthogonal to a direction along the spindle.

4. The workpiece grinding method according to claim 3, further comprising:

a final grinding step of grinding the one surface side of the workpiece in such a manner that the area of contact is not varied, after the second grinding step.

5. The workpiece grinding method according to claim 1, wherein, in the second grinding step, the increase and the decrease in the area of contact are repeated by varying an angle formed between a direction along the spindle and a direction along the rotational axis of the chuck table.

6. The workpiece grinding method according to claim 5, further comprising:

a final grinding step of grinding the one surface side of the workpiece in such a manner that the area of contact is not varied, after the second grinding step.

* * * * *